United States Patent [19]

Bernhardt et al.

[11] 4,191,310

[45] Mar. 4, 1980

[54] DEVICE FOR INFLATING LIFESAVING EQUIPMENT

[75] Inventors: Jost Bernhardt, Hamburg; Georg Hase; Peter Hase, both of Wedel; Klaus Hagen, Hamburg, all of Fed. Rep. of Germany

[73] Assignee: Bernhardt Apparatebau GmbH & Co., Hamburg, Fed. Rep. of Germany

[21] Appl. No.: 893,260

[22] Filed: Apr. 5, 1978

[30] Foreign Application Priority Data

Apr. 5, 1977 [DE] Fed. Rep. of Germany ... 771077[U]

[51] Int. Cl.[2] ..... B67B 7/24; F17C 00/00

[52] U.S. Cl. ..... 222/5; 9/318

[58] Field of Search ..... 222/3, 5, 54; 9/317, 9/318, 319, 320

[56] References Cited

U.S. PATENT DOCUMENTS

| | | | |
|---|---|---|---|
| 2,684,784 | 7/1954 | Fox | 222/54 X |
| 3,126,128 | 3/1964 | Borsack et al. | 222/54 X |
| 3,490,649 | 1/1970 | Sheridan | 9/319 X |

FOREIGN PATENT DOCUMENTS

| | | | |
|---|---|---|---|
| 2049442 | 4/1972 | Fed. Rep. of Germany | 222/5 |
| 690245 | 6/1930 | France | 222/5 |

*Primary Examiner*—David A. Scherbel

*Attorney, Agent, or Firm*—Becker & Becker, Inc.

[57] ABSTRACT

A device for inflating the floating body of lifesaving equipment, in which gas under pressure is released from a compressed gas containing container, normally closed by a diaphragm, into lifesaving equipment to be inflated, by causing a striker to pierce the diaphragm. The striker is movable against the diaphragm, selectively by a manually operable lever or by the thrust of a spring. In the last mentioned instance, a spring is held in its loaded condition by a control element having a section adapted to disintegrate in water. A lever system including a pivoting lever operatively engages the striker. When the pivoting lever is in its ineffective position and the spring is in loaded condition, the pivoting lever is continuously urged to its effective position, in which the lever system causes the striker to pierce the diaphragm. As long as the water soluble section of the control element is intact, the control element prevents movement of the pivoting lever from being moved by the spring to its effective position, but this action of the pivoting lever ceases as soon as the water soluble section disintegrates or dissolves under the influence of water.

9 Claims, 4 Drawing Figures

DEVICE FOR INFLATING LIFESAVING EQUIPMENT

The present invention relates to a device for inflating the floating body of a lifesaving device by means of gas under pressure, which is withdrawn from a pressure gas container closed by a diaphragm. The gas content is freed by opening the diaphragm by means of a striker which is arranged in a housing and which is movable against the diaphragm by means of a manually operable lever as well as by the thrust of a spring. The spring is held in its tensioned or loaded condition by means of an automatic or control element which loses its strength when contacted by water. A lever system comprising a pivotable lever is adapted to actuate a striker. The lever system is connected to a sliding member upon which the manually operable lever acts and to which the pivotable lever is linked.

With a device of this type which is known for instance from German Offenlegungsschrift No. 2,049,442, an elbow lever system acts upon said striker, the pivotable lever of said elbow system projecting upon the joint forming said elbow. The projecting end of the pivotable lever is located on the inclined surface of a conically designed body which is connected to one end of a displaceable rod. The other end of the pivotable lever is linked to a sliding member upon which, for manually releasing the device, there acts a manually operable lever designed as rotary knob. The rod which carries the conical body serves for automatically releasing the inflating device, and to this end, is by a water soluble automatic element against the thrust of a spring held in a position in which the elbow lever system is angled on. When the automatic element is acted upon by water, it loses its strength so that the spring displaces the rod. As a result thereof, the conical body slides along the projecting end of the pivotable lever and adjusts the latter in such a way that the elbow lever system is straightened out and the striker is pushed into the diaphragm of the pressure gas container. Inasmuch as the striker remains in the produced opening in the diaphragm, there exists the danger that this opening will again be closed by the escaping pressure gas and that the floating body will not be inflated sufficiently. This danger can be met by means of an expensive design of the tip of the striker, and more specifically by providing said tip for instance with helical notches. Furthermore with this known inflating device, it is not possible, after effected automatic release, to act upon the striker by the manually operable lever, in order to drive the striker into the diaphragm. This is due to the fact that for instance during the automatic release, the destruction of the diaphragm was not sufficient.

It is therefore, an object of the present invention to provide an inflating device for floatable lifesaving devices, which while assuring a maximum functional safety can be economically produced and can be handled in a simple manner.

These and other objects and advantages of the invention will appear more clearly from the following specification in connection with the accompanying drawings showing a diagrammatic section through a device according to the invention for inflating the floatable body of a lifesaving device, the showing in the various figures illustrating various phases of the operation of the device according to the invention.

The device according to the invention of the above mentioned general type is characterized primarily in that the pivotable lever is designed as a two-arm angle lever having a connecting link engaging the striker so linked to one end of said angle lever that when adjusting the pivotable lever, the latter, similar to a connecting rod, passes through a dead center point, and a reciprocable movement is conveyed to the striker, whereas the free other end of the pivotable lever is by means of a spring pressed against a tilting lever, which latter automatically interrupts an adjustment of the tilting lever due to the forces of the spring in its arresting position fixed by said automatic element.

If the inflating device according to the invention is in its loaded condition in which the tilting lever is arrested by means of an automatic element which is preferably designed as a tablet and loses its strength in the water, and if the pivoting lever due to the thrust of the spring engages the tilting lever, immersed in the water, the tablet disintegrates as soon as it comes into contact with water so that the tilting lever no longer can hold the pivoting lever. As a result thereof, the spring is able to release and thus to turn the pivotable lever about its linkage points on the sliding member. This turning movement is conveyed to a connecting link which together with the pivotable lever forms the lever system and causes the striker to engage the diaphragm for opening up the same. In view of the design of the pivotable lever according to the invention as a two-arm angle lever, the connecting link acts upon the striker in the manner of a connecting rod and pulls the same after the destruction of the diaphragm out of the opening created by the striker. This has the great advantage that the gas under pressure can unimpededly escape from the compressed gas container because the striker does not close the opening in the diaphragm. Thus, it is no longer necessary to shape the tip of the striker in a special way in order to assure an unimpeded escape of the compressed gas from the compressed gas container. A further advantage of the arrangement according to the invention is seen in the fact that by means of the manually operable lever, the striker can be moved against the diaphragm in loaded as well as in the unloaded or released condition of the released device. This is of particular importance if, during an automatic release of the inflating device, the striker has not sufficiently destroyed the diaphragm. The said advantage will be realized by the fact that the lever system forms a rigid connection between the sliding member and the striker.

Inasmuch as with the automatic release of the inflating device according to the invention the spring which moves the striker, acts not directly but through the lever system upon the striker, this spring can be dimensioned relatively weak so that it is possible to arrange the mechanism in a one-piece housing made of extruded synthetic material. This housing expediently within the region of the guide for the spring has a bore which serves as ventilating passage, and during the inflow of water into the housing prevents the formation of air pockets or air bubbles which could endanger the safety of function of the inflating device, particularly within the region of the automatic or control element. In order to prevent spray water from passing through the bore into the housing, the axis of the bore is preferably inclined downwardly with regard to the longitudinal axis of the housing. The transmission of the force of the spring onto a lever arrangement decreases the liability of such inflating devices to become moist which means the automatic release of the device which is provided for instance on life jackets, when the person wearing such life jacket is in an atmosphere with an extremely high air humidity because only very slight spring forces act upon the automatic or control element. In order after an automatic release of the inflating device to make the latter again ready for operation, it is only necessary to arrest the tilting lever by inserting a new watersensitive automatic element and to brace the pivotable lever to the tilting lever. To this end, according to a preferred embodiment of the invention, the pivot axis of the tilting lever as well as the tilting lever are displaceable parallel to the line of action of the spring in the housing of the device to such an extent that with the spring in relaxed condition, that end of the tilting lever which is operatively connected to the pivot lever engages from behind the free end of the pivot lever. After arrangement of an automatic element with a tensioning lever catching behind the pivot lever, the spring is tensioned by the fact that the pivot lever is by means of the tilting lever lifted against the thrust of the spring to such an extent that the ends of the interengaging levers occupy their arresting position secured by the automatic element. With this embodiment of the invention, the tilting lever may be journalled in a slide-shaped portion of the housing which simultaneously comprises means for holding the automatic element. The arrangement of this holding system in a slide furthermore yields the advantage that possible residues of a destroyed automatic element can be easily removed prior to the insertion of a new element.

For purposes of faciliting the insertion of a new automatic element into the released inflating device, it has proved advantageous by a spring to pre-tension the tilting lever into the position which makes possible the insertion of the automatic element. According to another expedient design of the device according to the invention, the spring acts upon a spring bolt which is provided with a slot through which the pivoting lever extends. The spring bolt represents guiding means for the spring and the pivoting lever and after an automatic release of the device projects from the housing so that it also acts as an indicating element which indicates the condition of operation of the device.

In order with as short a stroke as possible of the free end of the pivoting lever, to impart upon the striker a relatively long stroke, it is suggested according to the invention, to provide in the sliding member a gap which extends in the direction of movement of the striker, for journalling the axle of the pivoting lever to which is linked at least one connecting link which is operatively connected to the sliding member or the striker.

In order to make sure that after the diaphragm has been pierced and the gases passing through the whole in the diaphragm and act upon the striker will not exert undue stresses upon the lever system, it has been proved advantageous to link the connecting link between striker and pivoting lever by means of a pin guided in an oblong hole of the pivoting lever, to the latter.

Further objects and advantages will be apparent from the following description, reference being made to the drawings.

IN THE DRAWINGS

Figure 1:
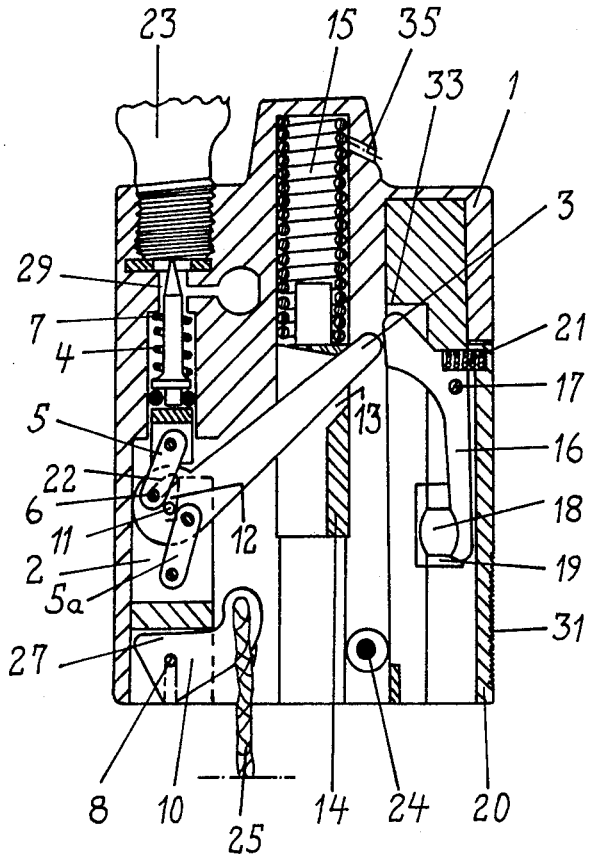
FIG. 1 is a sectioned elevational view of an inflating device having features in accordance with the present invention in condition of readiness for manual as well as automatic release.

Referring now to the drawings in detail, the inflating device according to the invention consists of a housing 1 which is made of one piece and consists of synthetic material. Screwed into said housing 1 is a neck of a compressed gas container, said neck being adapted to be closed by a diaphragm 34. In a bore of the housing which can be connected to a non-illustrated lifesaving device to be inflated by means of a branch of passage 29, there is arranged a striker 7 which is displaceable against the thrust of a return spring 4 but is so arranged as to be sealed. Linked to that end of the striker 7 which is located opposite the diaphragm 34 is a connecting link 5 which by means of a pin 6 is guided in an oblong hole 22 of a pivoting lever 3. The pivoting lever 3 is pivotable about a pin 11 which is held in a gap 12 of a sliding member 2. A further connecting link **5*a* is linked to the sliding member 2 and to the pivoting lever 3. The sliding member 2 which is displaceable in the direction of the axis of the striker 7 and is arranged in the housing 1 is by the return spring 7 pressed against the eccentric shaped adjusting surface of a manually operable lever 10 which latter has a release line 25 connected thereto. The manually operable lever 10 the free end of which carries the release line 25 is arranged in its ready position within the housing and is pivotable about a pin 8 which at the same time forms the counterbearing for the sliding member 2** and thus for the lever system.

Figure 3:
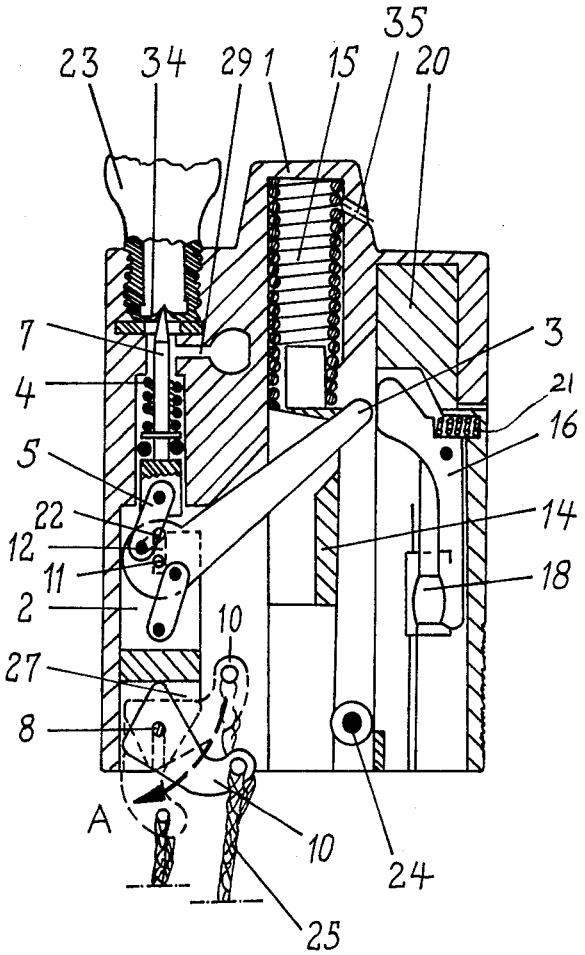
FIG. 3 is a sectioned elevational view showing features of the device released manually.

The pivoting lever 3 is passed through a slot 13 (FIG. 1) of a spring bolt 14 and, in loaded condition of the inflating device, has its free end engage a tilting lever 16 (FIGS. 1 and 3). A spring 15 acts upon a spring bolt 14 which is adapted, with automatic release of the inflating device to turn in clockwise direction about the pin 11 against an abutment 24.

The pin 17 of the tilting lever 16 is held in a slide shaped portion of the housing 1. This portion is adjustable parallel to the line of action of spring 15. The second end of the tilting lever 16 the first end of which is operatively connected to the pivoting lever 3, engages an automatic or control element 18 (FIGS. 1, 3 and 4) in a recess 19 which serves as holding means for said control element 18. A small pressure spring 21 in the slide 20 keeps the tilting lever 16 in its position which permits an easy insertion of the automatic element 18 in the recess 19. The access of water to the automatic or control element 18 is assured by a bore 35 in housing 1. This bore 35 together with the structurally required housing openings within the region of the manually operable lever 10 and of the spring bolt 14 will when water enters the housing 1, prevent the formation of air pockets or air bubbles, especially within the region of the automatic element 18. This bore 35 is arranged at an incline with regard to the longitudinal axis of the housing 1 and has its outer opening pointing downwardly. This brings about that for instance spray water will run off on the outside wall of housing 1 and will not enter the interior of the housing 1 while otherwise the automatic element 18 could prematurely be destroyed.

There will now be described the operation of the device according to the invention which in FIG. 1 is shown in condition of readiness for manual as well as for automatic release.

Figure 2:
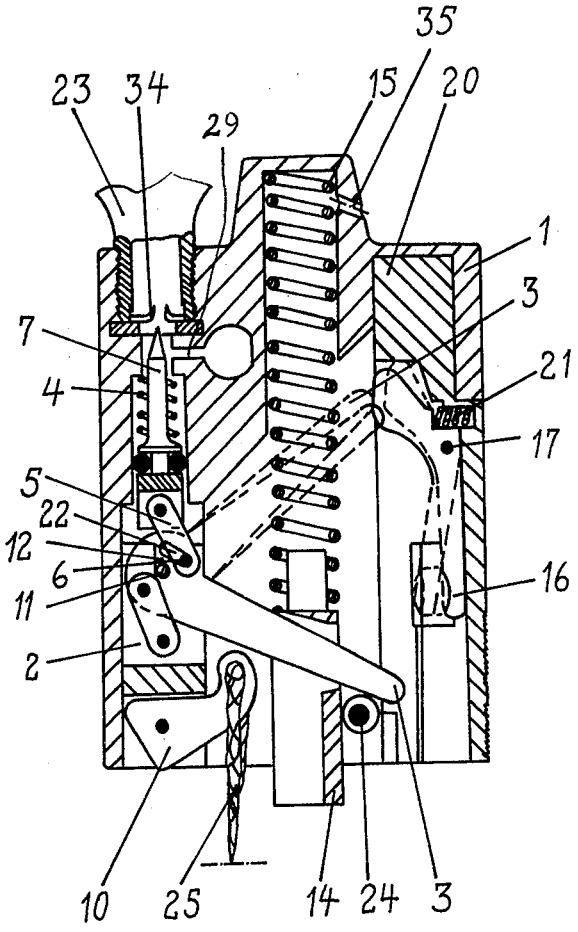
FIG. 2 is a sectioned elevational view showing features of the device released automatically.

When the automatic element 18 is subjected to the influence of water, for instance when the housing 1 immerses into the water, the automatic element 18 loses its strength and disintegrates whereby the tilting lever 16 is relieved. The tilting lever 16 will therefore under the influence of the thrust of spring 15, by the pivoting lever 13 be moved into the position shown in FIG. 2 in dash lines in which the lever 16 permits the rotary movement of the pivoting lever 3 in the direction toward the abutment 24. As soon as the tilting lever 16 no longer engages the pivoting lever 3, the tilting lever 16 is pivoted back by the pressure spring 21 into its starting position illustrated in FIG. 2 in solid lines. The pivoting lever 3 turns about the pin 11 and acts upon the lever system including the striker 7. In this connection the striker 7 is subjected to a reciprocatory movement, during which it destroys the diaphragm 34 of the pressure gas container 23 in a shock-like manner, and is pulled back from the thus generated opening (FIG. 2). The return movement of the striker 7 is on one hand aided by the gas which is under high pressure and instantaneously flows out of the pressure gas container 23, while on the other hand the oblong hole 22 in which the connecting link 5 is linked to the pivoting lever 3, will with a relatively short rotary stroke of the pivot lever 3 permit a long return stroke of the striker 7. This stroke by the striker 7 is effected exclusively by the return spring 4 and the gas flowing from the compressed gas container 23 whereby, at the same time, the striking effect upon the lever system and the counterbearing of the slide member 2, and the pin 8, is greatly reduced, which striking effect is derived from the gas pressure.

The spring 15 turns the pivoting lever 3 until its free end engages the abutment 24. In this position (FIG. 2) the spring bolt 14 projects from the housing 1. The projecting end serves as optical and touchable indication that the device according to the invention has been released automatically.

FIG. 3 shows the operation by manual release with loaded automatic system of the inflating device according to the invention. The eccentric of the manual lever 10 when in rest position is in engagement with the surface 27 on that bottom side of the slide 2 which is remote from the striker 7. By pulling the release line 25, the hand lever 10 is pivoted about pin 8 in the direction of the arrow A and moved into the position shown in solid lines. As a result thereof, the pivot lever 3 is together with the entire lever system lifted, and the striker 7 is pressed through the diaphragm 34. When further pulling the release line 25, the manual lever 10 is pivoted into the position shown in dash lines in which it projects from the housing 1. In this connection, the gas escaping from the compressed gas container 23 returns the striker 7 together with the lever system and the sliding member 2, into the starting position.

Inasmuch as the lever system in each position represents a rigid connection between the striker 7 and the sliding member 2, it will be appreciated that the manual release of the device can also be actuated effectively when the device is for instance in its FIG. 2 position.

Figure 4:
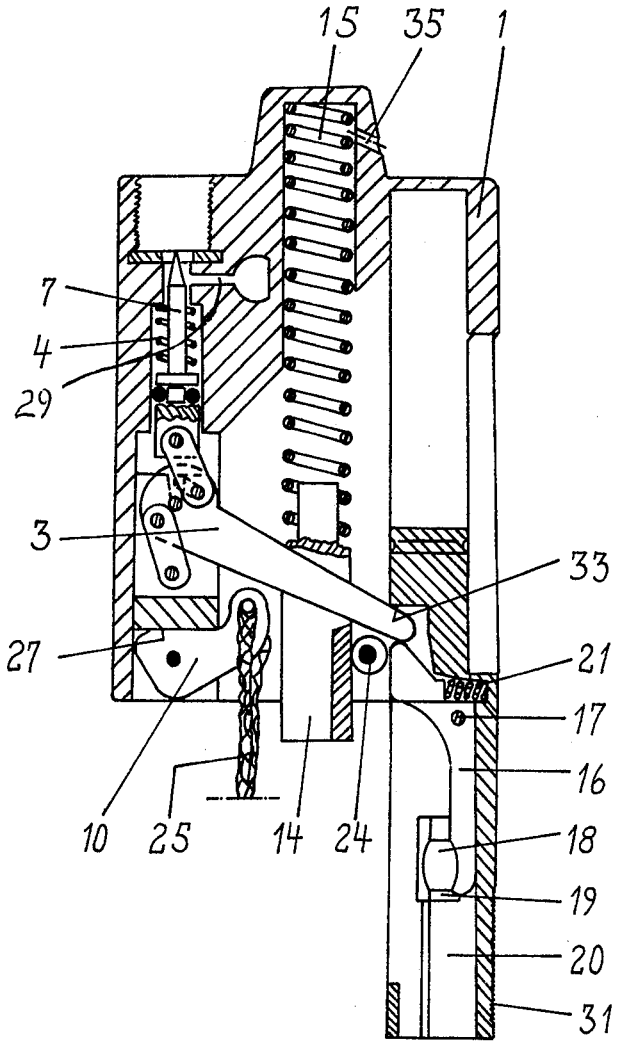
FIG. 4 is a sectioned elevational view after automatic release again to load the inflating device.

In order to be able after an automatic release again to load the inflating device according to the invention, the slide 20 is after removal of the compressed gas container 23 lifted out of the housing 1 to such an extent as it is shown in FIG. 4. This will be facilitated by a grooving 31 provided on the outside. In this position, the free end of the pivoting lever 3 is located behind the tilting lever 16 and engages an extension or protrusion 33 of the slide 20. As a result thereof, the slide 20 is kept in housing 1 in a non-losable manner. In this position, the pressure spring 21 sees to it that on one hand the tilting lever 16 catches the pivoting lever 3 from behind and on the other hand that the recess 19 is freed for an unimpeded insertion of a new automatic element 18. After the automatic element 18 has been inserted into the recess 19, the slide 20 is inserted into the housing until it occupies the position shown in FIG. 1 whereupon a new compressed gas container 23 is screwed into the housing 1.

It is, of course, to be understood that the present invention is, by no means, limited to the specific showing in the drawings, but also comprises any modifications within the scope of the appended claims. Thus, while the abutment 18 may be of various water soluble substances having sufficient strength to prevent the two-arm lever 16 from being pivoted by the spring as long as the water soluble abutment is not dissolved in water or another liquid, it has proved advantageous to make the abutment of salt or sugar in crystalline condition.

What we claim is:

1. A device for inflating the floating body of lifesaving equipment, which includes: a housing comprising passage means for connection to a body to be inflated, said housing also being provided with connecting means for connecting to said housing a pressure container adapted to store and furnish a gas under pressure, and provided with a diaphram normally closing off said pressure container, a striker reciprocably mounted in said housing and operable to pierce said diaphragm of a pressure container connected to said housing for establishing communication between said passage means and the interior of the pressure container connected to said housing, a manually operable lever operatively connected to said striker and operable to actuate said striker for causing the latter to pierce said diaphragm of a container connected to said housing, pivotable lever means pivotally journalled in said housing and having one end designed as free end and having its other end operatively connected to said striker, said free end being pivotable from an ineffective position in which said pivotable lever does not cause said striker to pierce a diaphragm of a pressure container connected to said housing toward an effective position to cause said striker to pierce said last mentioned diaphragm, a two-arm control lever pivotally arranged within said housing and having a first arm normally engaging said free end so as to hold the same in its ineffective position, said control lever also having a second arm, an abutment member comprising a water soluble section normally abutting said second arm of said control lever so as to prevent said first arm from releasing said free end of said pivotable lever means from its ineffective position, said water soluble section of said abutment member when disintegrated by contact with water becoming ineffective to thereby permit said first arm of said control lever to release said free end of said pivotable lever means and spring means continuously urging the free end of said pivotable lever means in the direction toward the effective position of the latter and being operable in response to said water soluble section becoming ineffective to move said free end toward its effective position to thereby cause said striker to pierce the diaphragm of a pressure container connected to said housing.

2. A device according to claim 1, which includes: a sliding member reciprocably guided in said housing and provided with a gapshaped aperture, said other end of said pivotable lever means comprising a pin journalled in said aperture, said other end also having an oblong hole, a connecting link having one end operatively connected to said striker and having its other end provided with a pin extending into and guided in said oblong hole, so that a pivoting of said pivotable lever means from its ineffective position toward its effective position about the axis of said last mentioned pin causes said striker to carry out a reciprocatory movement.

3. A device according to claim 1, in which said aperture extends in the direction of movement of said striker.

4. A device according to claim 1, which includes an additional slide engageable by said manually operable lever means, and also includes an additional link interconnecting said additional slide and said pivotable lever means.

5. A device according to claim 1, which includes a slide reciprocable in said housing, and in which the pivot axis of said control lever and the control lever itself are supported by said slide and in which said slide is displaceable parallel to the line of action of said spring means to such an extent that in the relaxed position of said spring means said first arm of said control lever engages said free end of said pivotable lever from behind.

6. A device according to claim 1, which includes a pressure spring continuously urging said first arm against said free end of said pivotal lever means when the latter is in its ineffective position.

7. A device according to claim 1, which includes a spring bolt reciprocably guided in said housing in axial direction of said spring means and provided with a transverse slot having said pivotable lever means extending therethrough, said spring means continuously urging said spring bolt in axial direction of said spring means.

8. A device according to claim 1, in which said housing comprises guiding means for guiding said spring means, and also comprises a venting passage arranged within the region of said guiding means.

9. A device according to claim 8, in which said venting passage extends at a downwardly directed inclination.

* * * * *

UNITED STATES PATENT AND TRADEMARK OFFICE

CERTIFICATE OF CORRECTION

PATENT NO. : 4,191,310
DATED : March 4, 1980
INVENTOR(S) : Jost Bernhardt et al

It is certified that error appears in the above—identified patent and that said Letters Patent is hereby corrected as shown below:

(30) Foreign Application Priority Data
should read -- Apr. 5, 1977 (DE) Fed. Rep. of Germany
7710770 (U) --.

Signed and Sealed this
Tenth Day of June 1980

[SEAL]

*Attest:*

SIDNEY A. DIAMOND

*Attesting Officer*

*Commissioner of Patents and Trademarks*